US005795408A

United States Patent [19]

Bittner et al.

[11] Patent Number: 5,795,408

[45] Date of Patent: Aug. 18, 1998

[54] PROCESS FOR THE PHOSPHATISING TREATMENT OF STEEL STRIP OR SHEET GALVANIZED ON ONE SIDE OR ALLOY GALVANIZED ON ONE SIDE

[75] Inventors: Klaus Bittner, Frankfurt am Main; Walter K.M. Jansen, Muelheim an der Ruhr; Klaus-Peter Mohr, Voerde; Thomas Wendel, Schwalbach; Hardy Wietzoreck, Frankfurt am Main, all of Germany

[73] Assignee: Metallgesellschaft Aktiengesellschaft, Frankfurt, Germany

[21] Appl. No.: 596,220

[22] PCT Filed: Jul. 29, 1994

[86] PCT No.: PCT/EP94/02510

§ 371 Date: Jul. 8, 1996

§ 102(e) Date: Jul. 8, 1996

[87] PCT Pub. No.: WO95/04842

PCT Pub. Date: Feb. 16, 1995

[30] Foreign Application Priority Data

Aug. 6, 1993 [DE] Germany ..... 43 26 388.7

[51] Int. Cl.[6] ..... C23C 22/07

[52] U.S. Cl. ..... 148/262; 148/240

[58] Field of Search ..... 148/262, 240; 204/181.3

[56] References Cited

U.S. PATENT DOCUMENTS

| | | | |
|---|---|---|---|
| 3,619,300 | 11/1971 | Heller | 148/262 |
| 4,402,765 | 9/1983 | Goto | 148/262 |
| 4,824,490 | 4/1989 | Oei | 148/262 |
| 5,152,849 | 10/1992 | Billner | 148/262 |
| 5,211,769 | 5/1993 | Sobata | 148/262 |
| 5,236,565 | 8/1993 | Maller | 148/262 |
| 5,244,512 | 9/1993 | Kawasaki | 148/262 |

*Primary Examiner*—Scott Kastler
*Attorney, Agent, or Firm*—Michael J. Striker

[57] ABSTRACT

The process forms a phosphate coating on a steel strip or sheet having a galvanized or alloy galvanized side and a steel side so that the phosphate coating is only present on the galvanized or alloy galvanized side. This process includes contacting the galvanized or alloy galvanized side of the steel strip or sheet with a phosphatizing solution for 4 to 20 seconds at a temperature of from 45° C. to 80° C. The phosphatizing solution has an S value of from 0.08 to 0.30 and contains 0.5 to 5 g/l zinc, 3 to 20 g/l $P_2O_5$, 0.020 to 0.2 g/l nitrite, 3 to 30 g/l nitrate and 0.2 to 2.5 g/l complexing agent for iron. Chelate forming substances, such as tartaric acid, citric acid, ethylenediamine-tetraacetic acid, nitrilotriacetic acid and/or oxalic acid, may be used as the complexing agent for iron. The phosphatizing solutions may also contain other bivalent cations, particularly manganese and/or nickel cations.

17 Claims, No Drawings

PROCESS FOR THE PHOSPHATISING TREATMENT OF STEEL STRIP OR SHEET GALVANIZED ON ONE SIDE OR ALLOY GALVANIZED ON ONE SIDE

The invention relates to a process for the phosphatising treatment of steel strip or sheet galvanised or alloy galvanised on one side, with the aid of phosphatising solutions which contain zinc, nitrate and nitrite.

The objective of the phosphatising of metals is to produce on the metal surface firmly intergrown metal/phosphate layers, which as such already improve the corrosion resistance and in conjunction with paints and other organic coatings contribute to a considerable increase in the adhesion and in the resistance to corrosion creeping in underneath the coating. In addition, these phosphate layers serve as an insulation against the passing through of electric current and in conjunction with lubricants they facilitate sliding operations.

For the pre-treatment prior to the painting, in particular the low-zinc phosphatising processes are suitable, in which the phosphatising solutions have comparatively low contents of zinc ions of, for example, 0.5 to 1.5 g/l (DE-C-22 32 067, EP-B-39 093). Under these conditions phosphate layers with a high content of phosphophyllite ($Zn_2FE(PO_4)_2.4H_2O$) are produced on the steel, which phosphophyllite is considerably more corrosion resistant than the hopeite ($Zn_3(PO_4)_2.4H_2O$) precipitated from phosphatising solutions with a higher zinc content. By also adding nickel and/or manganese ions to the low-zinc phosphatising solutions, the protection quality, in conjunction with paints, can be increased further (EP-A-228 151, EP-B-414 296, EP-B.414, 301, EP-A-544 650, DE-A-39 18 136). Low-zinc processes with the addition, of, for example, 0.5 to 1.5 g/l manganese ions and, for example, 0.3 to 2.0 g/l nickel ions, are used widely as so-called tri-cation processes for the preparation of metal surfaces for painting, e.g., for the cathodic electrophoretic enamelling of motor vehicle bodies.

Especially for phosphatising electrolytically galvanised or hot-dip galvanised steel strip, processes have been developed which permit the formation of a phosphate layer within short treatment times. Thus, for example, from the DE-A-32 45 411 it is known to provide in particular electrolytically galvanised steel strip with a phosphate layer which has a layer mass of less than 2 g/m$^2$, wherein solutions are used which contain 1 to 2.5 g/l zinc ions, have a content of free acid of 0.8 to 3 points and an acid ratio of total acid/free acid of 5 to 10. With this the treatment time should be not much more than 5 seconds. With another process for the phosphatising of electrolytically and/or hot-dip galvanised steel strip, for a period of 2 to 30 seconds, in the temperature range of 40° to 70° C., phosphatising solutions are applied, which contain 0.02 to 0.75 g/l zinc ions, 0.2 to 2.0 g/l manganese ions, 0.1 to 2.0 g/l nickel ions, 10 to 20 g/l phosphate ions and 0.5 to 30 g/l nitrate ions. With this the content of free acids must lie in the range of 1.6 to 3.0 points, the content of total acid in the range of 12 to 40 points, and the mass ratio of nickel ions to nitrate ions in the range of 1:10 to 1:60, and the mass ratio of manganese ions to nitrate ions in the range of 1:1 to 1:40 (DE-A-39 27 131).

When the aforementioned phosphatising solutions, which permit a short treatment time, are used on a strip which is galvanised or hot-dip galvanised on both sides, no serious complications occur. However, in recent times use is being made increasingly, in particular in the motor vehicle industry, of steel strip which is galvanised on only one side. When using the aforementioned short-time methods on strip that has been galvanised on only one side, a strong formation of phosphate sludge occurs in the phosphatising solution, which in this quantity is disturbing. In addition, on the steel side an incipient phosphate layer formation occurs, which is undesirable especially when a later phosphatising, e.g. of the motor vehicle body, is planned.

SUMMARY OF THE INVENTION

It is the object of the invention to provide a process for the phosphatising treatment of steel strip or sheet which is galvanised or alloy galvanised on one side, which process suppresses a sludge formation to a far-reaching extent, prevents the formation of a phosphate layer on the steel side, does not adversely affect the formation and quality of the phosphate layer on the galvanised or alloy galvanised side of the steel, and is nevertheless simple to use and economical.

To accomplish the object, the process of the type mentioned at the outset is carried out according to the invention in such a way that the galvanised or alloy galvanised steel strip or sheet is brought in contact, for 4 to 20 seconds, with a phosphating solution at a temperature of 45° to 80° C., which contains

| | | | | |
|---|---|---|---|---|
| 0,5 | to | 5 | g/l | zinc |
| 3 | to | 20 | g/l | $P_2O_5$ |
| 0,005 | to | 0,2 | g/l | nitrite |
| 3 | to | 30 | g/l | nitrate |
| 0,2 | to | 2,5 | g/l | complexing agent for iron, |

and has an S-value of 0.08 to 0.30 and also, for the phosphatising treatment of hot-dip galvanised or hot-dip alloy galvanised steel strip or sheet, an additional content of 0.2 to 4 g/l complex and/or simple fluoride (calculated as F).

It was found that with the above-mentioned concentrations of complexing agents for iron and nitrite, the iron dissolved from the side of the steel strip or sheet which is not galvanised or alloy galvanised, for the greater part undergoes a complex binding. A layer formation on the steel side cannot be ascertained. The formation of phosphate sludge in the phosphatising solution is completely stopped or reduced to a value of maximum 10% of the quantity of sludge otherwise observed. The desired phosphatising result on the galvanised or alloy galvanised side is not adversely affected.

The limits of the indicated ranges for complexing agents are important in so far that too high concentrations of complexing agents adversely affect the phosphate layer formation by a complexing of the layer-forming cations. When too little complexing agent is added, a phosphate sludge formation in the phosphatising solution and an incipient phosphate layer formation on the steel side cannot be avoided. With too high or too low a nitrite concentration, the phosphatising on the galvanised or alloy galvanised steel side and the complexing of the dissolved iron may be adversely affected. For example, with too high a nitrite concentration an incipient layer formation on the steel side cannot be avoided. Such an incipient layer formation may adversely affect the subsequent phosphatising in the motor vehicle plant, but at any rate causes an undesirable sludge formation.

To prevent an increase of the nitrite concentration to above the upper limit value as a result of the auto-catalytic nitrite formation at a normal throughput, it will normally be necessary to take suitable counter-measures. A particularly suitable counter-measure is to keep the nitrite concentration of the phosphating solution within the mentioned limits by means of nitrite-decomposing substances, such as urea and/ or amido sulphonic acid. This can be done by a continuous or intermittent adding. A particularly good method is to keep the nitrite concentration within the required limits by providing in the phosphatising solution a urea concentration of 1 to 3 g/l and/or an amido sulphonic acid concentration of 0,5 to 2 g/l. This creates a stationary state in that the urea or amido sulphonic acid content decomposes just as much nitrite as is produced by auto-catalysis.

The steel strip or sheet to be used in the process according to the invention may on the galvanised or alloy galvanised side have layers of electrolytic zinc (ZE), hot-dip zinc (Z), or alloys on the basis zinc/nickel (ZNE), zinc/iron (ZF) or zinc/aluminium (Za or AZ).

The latter normally also include alloys with, for example, 55% by mass Al and 45% by mass Zn.

A preferred embodiment of the invention consists in that galvanised or alloy galvanised steel strip or sheet is brought in contact with a phosphatising solution which contains

| | | | | |
|---|---|---|---|---|
| 1 | to | 2,5 | g/l | zinc |
| 10 | to | 20 | g/l | $P_2O_5$ |
| 0,020 | to | 0,060 | g/l | nitrite |
| 5 | to | 15 | g/l | nitrate |
| 0,2 | to | 2,5 | g/l | complexing agent for iron, |

and has an S value of 0,12 to 0,20. This embodiment of the invention has the advantage the particularly little sludge is formed and that in addition good phosphate layers are produced on the galvanised or alloy galvanised side.

Particularly advantageous results are obtained when according to an advantageous embodiment of the invention the galvanised or alloy galvanised steel strip or sheet is brought in contact with a solution which as complexing agent contains chelate forming substances, such as tartaric acid, citric acid, ethylenediamine tetraacetic acid, nitrilotriacetic acid and/or oxalic acid. With this the content of the above-mentioned complexing agents in the phosphatising solutions should preferably amount to:

| | | | | |
|---|---|---|---|---|
| 0,5 | to | 2,5 | g/l | tartaric acid |
| 0,2 | to | 0,4 | g/l | citric acid |
| 0,2 | to | 2,5 | g/l | nitrilotriacetic acid or ethylenediaminetetraacetic acid (calculated as ethylenediamine tetraacetic acid). |

The quality of the produced phosphate layer can be improved when according to a further embodiment of the invention the galvanised or alloy galvanised steel strip or sheet is brought in contact with a phosphatising solution which contains other bivalent cations, in particular manganese and/or nickel ions. In this case it is advantageous to adjust the concentrations in the phosphatising solution to 1 to 3 g/l, in particular 1,5 to 2,5 g/l manganese ions, and/or 0,1 to 2,5 g/l, in particular 0,5 to 1,5 g/l nickel ions.

Because of the required higher aggressivity of the phosphatising solution, when treating hot-dip galvanised or hot-dip alloy galvanised steel strip or sheet, it is indispensable to work with phosphatising solutions which contain complex and/or simple fluoride.

However, according to a further advantageous embodiment of the invention, also when treating electrolytically galvanised steel strip or sheet, phosphatising solutions are used which contain complex and/or simple fluoride, preferably in quantities of 0,1 to 3 g/l (calculated as F). As complex fluoride, fluoroborate, fluorosilicate, fluorotitanate and/or fluorozirconate are preferred.

The phosphatising treatment of the strip or sheet can take place by conventional methods, i.e., by dipping or spraying. It is, however, particularly advantageous to apply the solution by the spraying method.

The phosphatising solution is normally supplemented by a supplementation concentrate, wherein the control takes place, for example, automatically by a conductivity measuring. A suitable supplementation concentrate contains, for example, 10 to 30% by mass, $P_2O_5$, 3 to 20% by mass $NO_3$ and 0 to 2% by mass zinc. The zinc content in the supplementation concentrate depends mainly on the reactivity of the layer of zinc or alloy zinc present on the steel strip or sheet. If this layer has a higher reactivity and as a result thereof larger quantities of zinc get into the bath due to the pickling effect on the phosphatising solution, a supplementation solution with lower zinc concentrations in the range of 0 to 2% by mass is possible. In the extreme case, i.e., in particular with a phosphatising treatment which follows immediately upon the galvanising of the steel strip, the supplementation concentrate may also be free of zinc.

In the preferred embodiment of the process according to the invention—with a nickel and/or manganese ions content of the phosphatising solution—the supplementation concentrate contains a further 0,2 to 2% by mass nickel and/or 1 to 4% by mass manganese.

In principle, the supplementation solution may also already contain the complexing agents for iron and, if required, the nitrite-decomposing substance; however, for reasons of a better adjustability of the required concentrations it will generally be preferable to supplement these two substances separately.

With the aid of the process according to the invention phosphate, layers are produced, the layer mass of which amounts to about 1 to 2 g/m$^2$.

The invention will be explained by way of example and in greater detail with reference to the following example:

EXAMPLE

Immediately following the electrolytic galvanising of steel strip, a phosphatising took place with a solution which contains:

| | | |
|---|---|---|
| Zinc: | 1,8 | g/l |
| $P_2O_5$: | 14,5 | g/l |
| Nickel: | 1,3 | g/l |
| Manganese: | 2,0 | g/l |
| Tartaric acid: | 1 | g/l |
| Urea: | 1 | g/l |
| nitrate: | 7 | g/l |
| nitrite: | 0,040 | g/l |

The S value of the phosphatising solution was 0,17, the temperature of the phosphating solution was adjusted to 50° to 55° C. The application took place by spraying for the duration of 8 seconds.

The phosphatising treatment took place over a period of 16 hours with a bath size of 25 m$^3$. Following this a wet-sludge quantity of 2 ml/l of phosphatising solution was determined. This corresponds to about 0,6 ml sludge per m$^2$ of steel surface passed through the bath. On the zinc side a perfect phosphate layer had formed, the layer mass of which 1,6 g/m$^2$. The steel side was in perfect condition, i.e., displayed hardly any layer formation.

During a comparison test in which no complexing agents and nitrite-decomposing substance were added, but under otherwise identical conditions, a wet sludge quantity of 28 ml/l of phosphatising solution was ascertained. This corresponds to about 8.4 ml sludge per $m^2$ of steel surface passed through the bath. The layer mass on the zinc side also here amounted to 1.6 $g/m^2$, but the steel side displayed an incipient phosphate layer formation.

We claim:

1. A process for formation of a phosphate coating on a steel strip or sheet having a galvanized or alloy galvanized side and a steel side so that the phosphate coating is formed only on the galvanized or alloy galvanized side, said process comprising contacting the steel strip or sheet with a phosphatizing solution for 4 to 20 seconds at a temperature of from 45° C. to 80° C., wherein said phosphatizing solution contains

| | |
|---|---|
| 0.5 to 5 g/l | zinc, |
| 3 to 20 g/l | $P_2O_5$, |
| 0.020 to 0.2 g/l | nitrite, |
| 3 to 30 g/l | nitrate, |
| 0.2 to 2.5 g/l | complexing agent for iron, |

and has an S value of 0.08 to 030, so that the phosphate coating is formed only on the galvanized or alloy galvanized side and not on the steel side of the steel strip or sheet.

2. The process as defined in claim 1, wherein the phosphatizing solution includes from 0.2 to 4 g/l fluoride in complex or simple form as calculated on the basis of F when the galvanized or alloy galvanized side of the steel strip or sheet has been provided on the steel strip or sheet by hot-dip galvanizing or hot-dip alloy galvanizing.

3. The process as defined in claim 1, wherein the phosphatizing solution includes at least one nitrite concentration stabilizing agent selected from the group consisting of urea and amidosulphonic acid in amounts suitable to keep the nitrite concentration between said 0.020 to 0.2 g/l.

4. The process as defined in claim 1, wherein the phosphatizing solution includes from 1 to 3 g/l of urea so as to maintain said nitrite between said 0.020 to 0.2 g/l.

5. The process as defined in claim 1, wherein the phosphatizing solution includes from 0.5 to 2 g/l of amidosulphonic acid so as to maintain said nitrite between said 0.020 to 0.2 g/l.

6. The process as defined in claim 1, wherein the phosphatizing solution contains

| | | | | |
|---|---|---|---|---|
| 1 | to | 2.5 | g/l | of said zinc, |
| 10 | to | 20 | g/l | of said $P_2O_5$, |
| 0.020 | to | 0.060 | g/l | of said nitrite |

-continued

| | | | | |
|---|---|---|---|---|
| 5 | to | 15 | g/l | of said nitrate |
| 0.2 | to | 2.5 | g/l | of said complexing agent for |

iron, and said S value is from 0.12 to 0.20.

7. The process as defined in claim 1, wherein the completing agent for iron is at least one member selected from the group consisting of tartaric acid, citric acid, ethylenediaminetetraacetic acid, nitrilotriacetic acid and oxalic acid.

8. The process as defined in claim 7, wherein the phosphatizing solution includes from 0.5 to 2.5 g/l of said tartaric acid or from 0.2 to 0.4 g/l of said citric acid as the complexing agent for iron.

9. The process as defined in claim 7, wherein the phosphatizing solution includes from 0.2 to 2.5 g/l of said ethylenediaminetetraacetic acid or from 0.2 to 2.5 g/l of said nitrilotriacetic acid, calculated as said ethylenediaminetetraacetic acid, as the complexing agent for iron.

10. The process as defined in claim 1, wherein the phosphatizing solution includes at least one bivalent cation selected from the group consisting of manganese cations and nickel cations.

11. The process as defined in claim 10, wherein the phosphatizing solution includes from 1 to 3 g/l of said manganese cations.

12. The process as defined in claim 10, wherein the phosphatizing solution includes from 1.5 to 2.5 g/l of said manganese cations.

13. The process as defined in claim 10, wherein the phosphatizing solution includes from 0.1 to 2.5 g/l of said nickel cations.

14. The process as defined in claim 10, wherein the phosphatizing solution includes from 0.5 to 1.5 g/l of said nickel cations.

15. The process as defined in claim 1, wherein the phosphatizing solution includes from 0.1 to 3 g/l fluoride in complex or simple form as calculated on the basis of F when the galvanized or alloy galvanized side of the steel strip or sheet has been provided on the steel strip or sheet by hot-dip galvanizing or hot-dip alloy galvanizing.

16. The process as defined in claim 15, wherein the fluoride in complex form is at least one member selected from the group consisting of fluoroborate, fluorosilicate, fluorotitanate and fluorozirconate.

17. The process as defined in claim 1, wherein the contacting with the phosphatizing solution takes place by spraying the phosphatizing solution on the steel strip or sheet.

* * * * *